United States Patent [19]

Miura et al.

[11] 4,402,630

[45] Sep. 6, 1983

[54] MACHINE FOR AND METHOD OF HARDENING SOFT GROUND

[75] Inventors: Mituo Miura; Yoshinori Kukino; Takumi Fujii; Kazunori Sugiyama; Takashi Inoue; Mamoru Ogishima, all of Tokyo, Japan

[73] Assignees: Takenaka Komuten Co., Ltd., Osaka; Takenaka Doboku Co., Ltd., Tokyo, both of Japan

[21] Appl. No.: 355,647

[22] Filed: Mar. 8, 1982

[51] Int. Cl.[3] ..... E02D 3/12

[52] U.S. Cl. ..... 405/266; 405/263; 405/258

[58] Field of Search ..... 175/61, 73, 74, 76; 285/118; 405/263–266, 269, 258

[56] References Cited

U.S. PATENT DOCUMENTS

| | | | |
|---|---|---|---|
| 2,782,605 | 9/1952 | Wertz et al. | 405/266 |
| 3,800,544 | 4/1974 | Nakanishi | 405/266 |
| 4,084,383 | 4/1978 | Kukino et al. | 405/269 |

FOREIGN PATENT DOCUMENTS

| | | | |
|---|---|---|---|
| 55-98521 | 7/1980 | Japan | 405/266 |
| 55-101618 | 8/1980 | Japan | 405/258 |
| 55-115417 | 9/1981 | Japan | 405/263 |
| 229397 | 10/1968 | U.S.S.R. | 175/73 |
| 727742 | 4/1980 | U.S.S.R. | 405/258 |

*Primary Examiner*—Dennis L. Taylor
*Assistant Examiner*—John A. Gungor

[57] ABSTRACT

Agitation shafts provided with agitation vanes at lower portions thereof are fixed rotatably around a support cylinder to form a soft ground hardening machine. A direction control unit is provided at a lower portion of the support cylinder so as to control the direction in which the machine is inserted into and withdrawn from the soft ground. In a method of hardening the soft ground by using this machine, the direction in which the machine is inserted into and withdrawn from the soft ground is controlled as the direction in which the machine is being inserted into or withdrawn from the soft ground is measured.

9 Claims, 19 Drawing Figures

MACHINE FOR AND METHOD OF HARDENING SOFT GROUND

BACKGROUND OF THE INVENTION

1. Field of the Invention

This invention relates to a machine for and a method of hardening the soft ground, which machine is capable of being inserted into or withdrawn from the soft ground in the perpendicular or a predetermined direction during a soft ground hardening operation.

2. Description of the Prior Art

In order to treat the soft ground by a method of hardening the soft ground in depths, a soft ground hardening machine is used, which has an extremely large length and small width. While a deep portion of the soft ground is treated with such an elongated machine, the direction in which the machine is inserted into or withdrawn from the soft ground is liable to be deviated from the perpendicular or a predetermined direction, in which the machine should be moved. This makes it difficult to form a hardened wall in the soft ground in a predetermined manner.

When the direction in which the soft ground hardening machine is inserted into or withdrawn from the soft ground is deviated from a predetermined direction, in which the machine should be moved, the ship from which the machine is suspended is inclined, and the elongated machine is moved forward and backward, and rightward and leftward with an upper portion thereof fixedly held, to thereby eliminate the above-mentioned deviation. According to the above-described method, a high restraining force is applied from the soft ground to the soft ground hardening machine after the machine has been inserted into the soft ground to a certain extent, so that it is difficult to control the direction of the movement of the machine.

SUMMARY OF THE INVENTION

An object of the present invention is to provide a soft ground hardening machine capable of being controlled with respect to the direction, in which the machine is inserted into or withdrawn from the soft ground.

Another object of the present invention is to harden the soft ground accurately in a predetermined manner with the mentioned soft ground hardening machine by operating a direction control unit while measuring an angle of inclination of the machine.

Still another object of the present invention is to provide a method of hardening the soft ground accurately while eliminating the inclination of an end portion of the soft ground hardening machine.

The above and other objects as well as advantageous features of the invention will become apparent from the following description of the preferred embodiments taken in conjunction with the accompanying drawings.

BRIEF DESCRIPTION OF THE DRAWINGS

FIGS. 17–19 illustrate an eleventh embodiment, wherein:

FIG. 17 is a front elevational view of the whole;

FIG. 18 is a front elevational view of a direction control unit provided at a lower end portion thereof; and FIG. 19 is an enlarged view of a joint portion of an agitation shaft provided therein.

DESCRIPTION OF THE PREFERRED EMBODIMENTS

Figure 1:
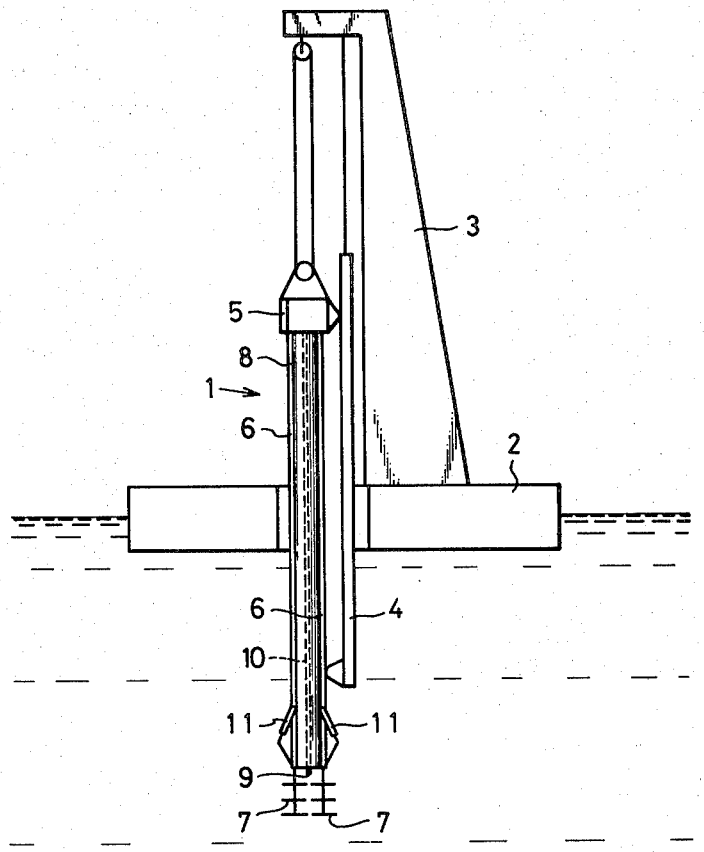
FIG. 1 is a schematic diagram of a soft ground hardening machine having a direction control unit according to the present invention.
Figure 2:
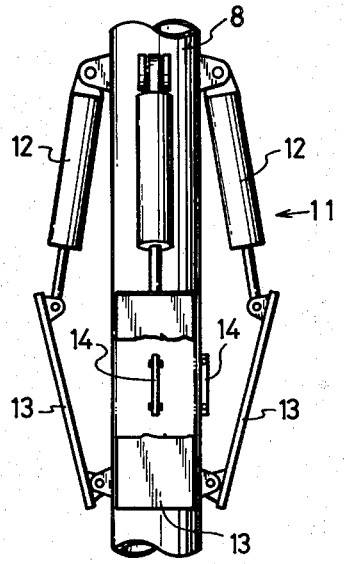
FIG. 2 is an enlarged side elevation view of the direction control unit.
Figure 3:
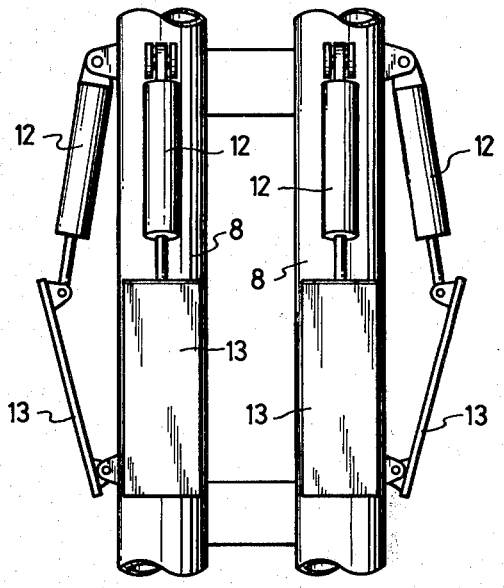
FIG. 3 is a front elevational view of the direction control unit shown in FIG. 2.

A machine for and a method of hardening the soft ground according to the present invention will be described with reference to FIGS. 1–4.

A machine 1 for hardening the soft ground in depths is suspended via a wire from a tower 3, which is set up on a ship 2, in such a manner that the machine 1 can be moved up and down. The machine 1 is moved up and down as it is guided by a leader 4. The machine 1 is provided under a rotary driving unit 5 therefor with a plurality of elongated agitation shafts 6, each of which has at a lower portion thereof a plurality of agitation vanes 7 attached thereto. The agitation shafts 6 are held rotatably on a support cylinder 8, which is extended below the rotary driving unit 5, and which has so large a length that the support cylinder 8 reaches a position in the vicinity of the agitation vanes 7. The support cylinder 8 may consist of a frame or an elongated rod. A hardener supply pipe 10 is held in the support cylinder 8 in such a manner that a discharge port 9 thereof for a hardener is positioned in the vicinity of the agitation vanes 7. The hardener supply pipe 10 is communicated at an upper end thereof with a hardener tank (not shown). A structure for supplying a hardener is not limited to the structure formed in the above-described manner; a structure for this purpose may be so formed that a hardener can be passed through the agitation shafts to be discharged from the lower ends thereof or the agitation vanes.

Figure 4:
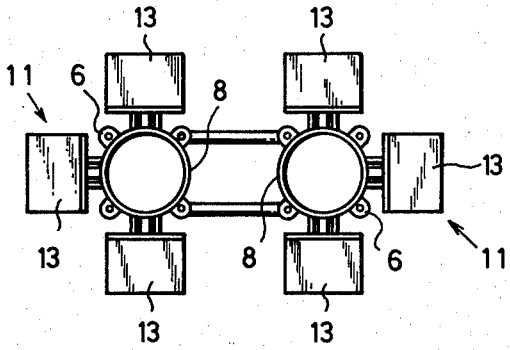
FIG. 4 is a horizontal sectional view of the direction control unit shown in FIG. 2.

Direction control units 11 are attached to a lower portion of the support cylinder 8. In order to eliminate the deviation of the direction, in which the soft ground hardening machine is actually moved, from a predetermined direction, in which the machine should be moved, it is necessary that the direction control units 11 be provided on four portions, i.e. front, rear, right and left portions, of the machine 1. When the machine 1 is provided with two support cylinders 8 as shown in FIG. 4, to have eight agitation shafts 6, the direction control units 11 are provided on the front, rear and laterally outer sides of each of the support cylinders 8. Namely, a total of six direction control units 11 are provided. The direction control units 11 may be provided on the right and left sides only, or front and rear sides only of the support cylinder 8 in accordance with different purposes thereof.

Each of the perpendicular insertion control units 11 consists of cylinders 12 fastened pivotably at their respective base ends to the support cylinder 8, and control plates 13, each of which is fastened pivotably at both ends thereof to an end of a piston rod moving in the cylinder 12 and the support cylinder 8. Each of the control plates 13 is projected sideways at one end thereof in accordance with the forward and backward movements of a piston in the cylinder 12 as an amount of projection of the control plate 13 is controlled suitably. In addition, measuring instruments 14, 14' for use in determining angles of inclination of a lower portion of the support cylinder 8 with respect to two directions, i.e. the longitudinal and lateral directions are attached to the support cylinder 8. The measurement values can be transmitted electrically from the instruments 14, 14' to the ship 2.

In order to treat the soft ground by using the machine 1 having the above-described direction control units 11, the agitation shafts 6 are inserted into the soft ground as they are rotated. As the insertion of the agitation shafts 6 progresses, it is ascertained with a signal transmitted momentarily from the inclination-angle measuring instruments 14, 14' that the machine 1 is being inserted into the soft ground in the perpendicular or a predetermined direction.

When the occurrence of a deviation of the direction, in which the machine 1 is actually moved, from a predetermined direction, in which the machine should be moved, is detected with the above-mentioned signal, the direction control unit 11 provided on that side of the support cylinder 8 which has advanced in the wrong direction is operated to move the piston in the cylinder 12 backwardly, so that the control plate 13 is pressed against the inner circumferential surface of the bore in the soft ground, through which the agitation vanes 7 have passed. When the control plate 13 is pressed against the inner surface of the mentioned bore, lateral reaction force occurs in the former, so that the deviation occurring in the end portion of the machine 1 is eliminated.

When the movement of the agitation shafts 6 in a predetermined direction has thereafter been detected, the piston in the cylinder 12 is returned to the original position to insert the machine 1 into the soft ground again. After the agitation shafts 6 have been inserted to a predetermined depth, the machine 1 is withdrawn. A hardener may be discharged in the vicinity of the agitation vanes 7 either when the machine 1 is inserted into the soft ground or when the machine 1 is withdrawn therefrom.

As described above, when the machine 1 using the direction control units according to the present invention is inserted into the soft ground to be deviated at a lower end portion thereof from a predetermined direction in which the machine 1 should be moved, the lower end portion thus deviated of the machine 1 can be inclined in the opposite direction to eliminate the deviation thereof. Accordingly, the machine 1 can be inserted into the soft ground correctly, and the soft ground can be hardened accurately.

Figure 5:
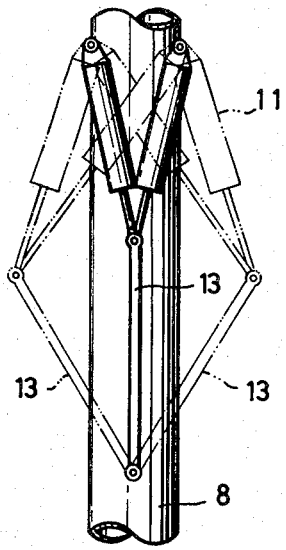
FIGS. 5 and 6 are a side elevational view and a front elevational view, respectively, of a direction control unit in a second embodiment.
Figure 6:
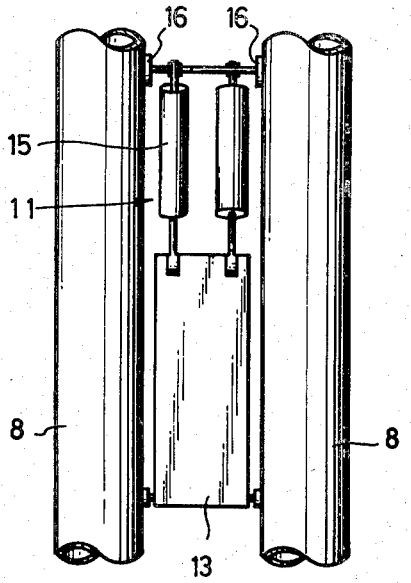

A second embodiment of the present invention will be described with reference to FIGS. 5 and 6. In this embodiment, one direction control unit 11 is provided between two support cylinders 8 to eliminate a deviation of the machine 1 in the longitudinal direction from a predetermined direction, in which the machine 1 should be moved. A control plate 13 in the direction control unit 11 is supported pivotably at a lower end thereof on the two support cylinders 8. The control plate 13 is connected pivotably at the other end thereof to two cylinders 15, 15'. The cylinders 15, 15' are supported pivotably at their respective base ends on retainer frames 16, which are fastened to the support cylinders 8, in such a manner that the base ends of the cylinders 15, 15' are spaced from each other in the longitudinal direction. The control plate 13 can be inclined in the forward and backward direction as shown in two-dot chain line in FIG. 5, by controlling the movements of the pistons in the two cylinders 15, 15'.

Therefore, when the control plate 13 is inclined, it advances in the soft ground as the machine 1 is moved therethrough. As a result, the machine 1 advances in the direction in which the control plate 13 is inclined, so that the machine 1 can be inserted into the soft ground in a predetermined direction with the deviation of the machine 1 therefrom thus eliminated. Those parts of the construction and effect of the second embodiment, which are not referred to above are identical with the corresponding parts of the construction and effect of the first embodiment.

Figure 7:
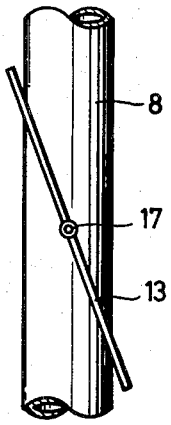
FIGS. 7 and 8 are a side elevational view and a front elevational view, respectively, of a direction control unit in a third embodiment.
Figure 8:
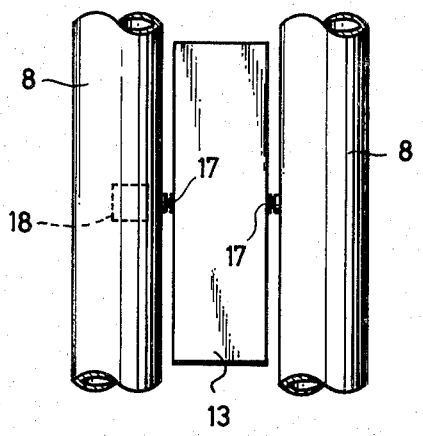

A third embodiment will be described with reference to FIGS. 7 and 8. In this embodiment, a control plate 13, which can be inclined, is provided between two support cylinders 8 in the same manner as in the second embodiment. The third embodiment is so constructed that a shaft 17 projecting from both sides of the control plate 13 is held in support frames provided on the support cylindes 8, which shaft 17 is adapted to be turned by a driving means 18, which is provided in the support cylinder 8, to cause the control plate 13 to be inclined gradually. Owing to the control plate 13 thus inclined, the direction of insertion of the machine 1 can be corrected in the same manner as in the second embodiment. When the machine 1 is withdrawn from the soft ground, the direction of movement thereof can also be controlled by inclining the control plate 13 at a suitable angle.

Figure 9:
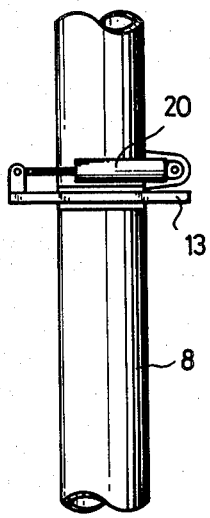
FIGS. 9 and 10 are a side elevational view and a front elevational view, respectively, of a direction control unit in a fourth embodiment.
Figure 10:
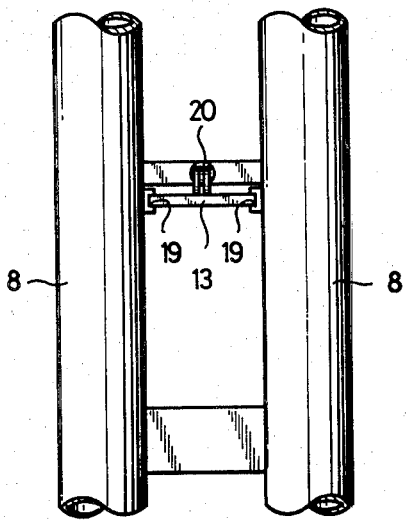

A fourth embodiment will be described with reference to FIGS. 9 and 10. In this embodiment, guide grooves 19, which is extended in the longitudinal direction, are provided in the opposite inner surfaces of the support cylinders 8. A control plate 13 is also provided, which can be moved slidingly as it is guided by the grooves 19, and a jack 20, which is adapted to move the control plate 13 slidingly, is held on the support cylinders 8 via support frames.

Therefore, when the control plate 13 is projected sideways, a free end thereof meets with vertical resistance of the soft ground, through which the agitation vanes have been passed, as well as longitudinal resistance occurring due to the unbalanced flow of earth on the front and rear sides of the control plate 13. The lower end of the machine advances in the direction, in which the control plate 13 meets with the longitudinal resistance, so that the direction in which the machine 1 is moved can be corrected. Thus, the direction, in which the machine 1 is inserted into the soft ground, and the direction, in which the machine is withdrawn therefrom, can be corrected.

A fifth embodiment will be described with reference to FIG. 11. In this embodiment, a lower portion of a control plate 13 is held pivotably on a support cylinder 8 via a bracket, and an upper portion thereof is also held pivotably on the support cylinder 8 via a bracket and two links 21, which are connected pivotably with each other. An end of a cylinder 22 is connected pivotably to the joint portions of the links 21, and a base portion of the cylinder 22 is held pivotably on the support cylinder 8.

Figure 11:
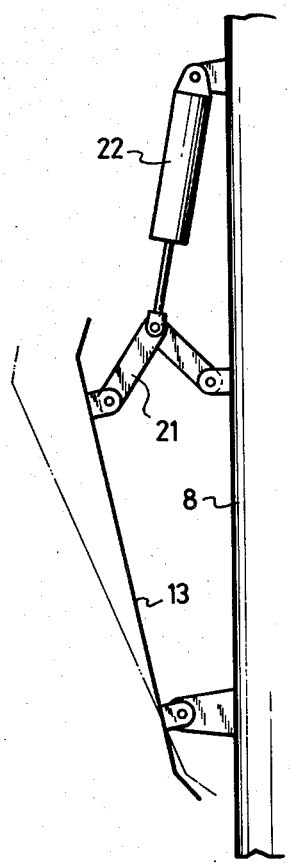
FIGS. 11, 12, 13, 14, 15 and 16 are side elevational views of direction control units in fifth, sixth, seventh, eighth, ninth and tenth embodiments, respectively.

Therefore, when the piston in the cylinder 22 is moved backward, the control plate 13 is inclined as shown in two-dot chain line in FIG. 11, so that an upper portion of the control plate 13 is pressed against the inner surface of the bore made by the machine 1. Thus, the direction, in which the machine 1 is inserted into the soft ground, can be corrected.

Figure 12:
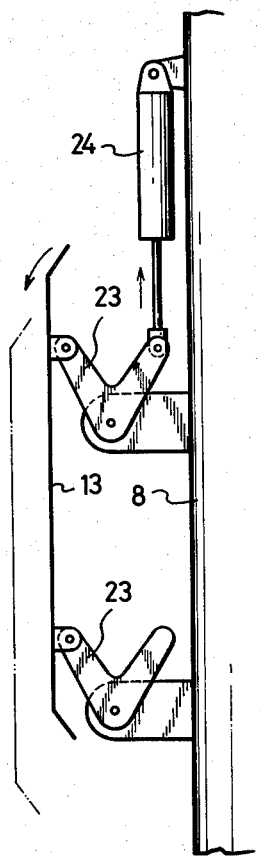

A sixth embodiment will be described with reference to FIG. 12. In this embodiment, a control plate 13 is adapted to be moved parallel to the support cylinder 8 by means of parallel links. This embodiment is so constructed that dog-legged links 23 are supported pivotably at one end of each thereof on two vertically spaced portions of the control plate 13, which doglegged links 23 are further held pivotably at their respective intermediate portions on the support shaft 8 via brackets with the upper doglegged link connected pivotably at the other end thereof to a lower end of a cylinder 24, a base end portion of the cylinder 24 being fastened pivotably to the support cylinder 8.

Therefore, the control plate 13 can be pressed against the inner surface of a bore made by the machine 1, by moving the piston in the cylinder 24 in the forward and backward directions. Thus, the direction, in which the machine 1 is inserted into and withdrawn from the soft ground can be corrected.

Figure 13:
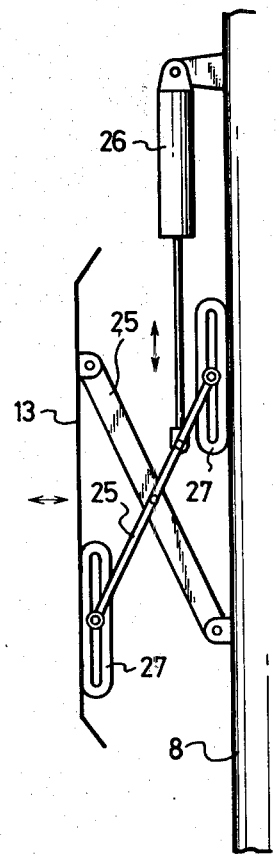

A seventh embodiment will be described with reference to FIG. 13. In this embodiment, two links 25, which are connected pivotably to each other at intermediate portions thereof, and a cylinder 26. One of the links 25 is adapted to be moved slidingly along guides 27 provided on a control plate 13 and a support cylinder 8.

Therefore, an angle of inclination of the links 25 can be varied by moving the piston in the cylinder 26 forward and backward, so that the control plate 13 can be moved outward as it is kept parallel to the support cylinder 8. Owing to such an outward movement of the control plate 13, the direction, in which the machine 1 is inserted into and withdraw from the soft ground, can be corrected.

Figure 14:
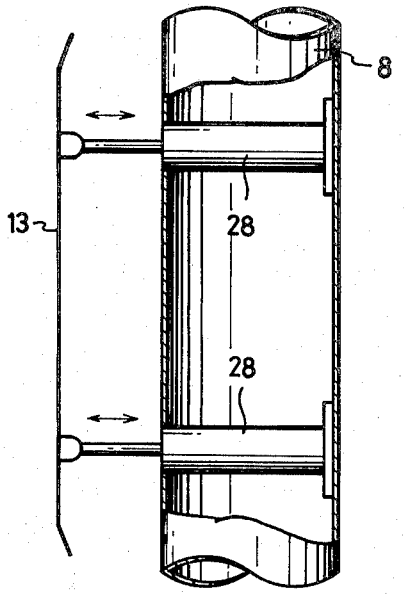

An eighth embodiment will be described with reference to FIG. 14. In this embodiment, a control plate 13 is fixed to outer ends of cylinders 28 provided on a support cylinder 8. The cylinders 28 may be connected to the control plate 13 with pins. In such a structure, the control plate 13 can be moved outward by moving the pistons in the cylinders 28 forward and backward. Thus, the direction, in which the machine 1 is inserted into and withdrawn from the soft ground, can be corrected.

Figure 15:
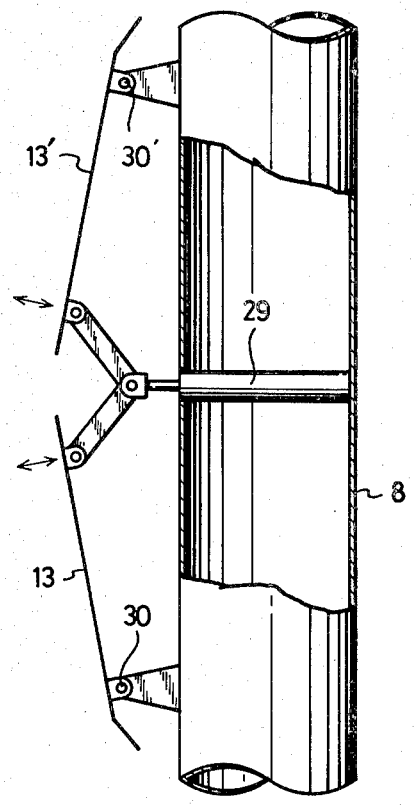

A ninth embodiment will be described with reference to FIG. 15. In this embodiment, two control plates 13, 13' are used. The opposite end portions of the control plates 13, 13' are joined to an outer end portion of a cylinder 29 via a connecting member, and a base portion of the cylinder 29 is fastened to a support cylinder 8. The other ends of the control plates 13, 13' are held pivotably 30, 30' on the support cylinder 8 via brackets. The control plates 13, 13' can be moved pivotably around the shafts 30, 30'.

Therefore, the two control plates 13, 13' can be moved outward as they are inclined at an arbitrary angle, by moving the piston in the cylinder 29 forward and backward. Thus, the direction, in which the machine 1 is inserted into and withdrawn from the soft ground, can be corrected.

Figure 16:
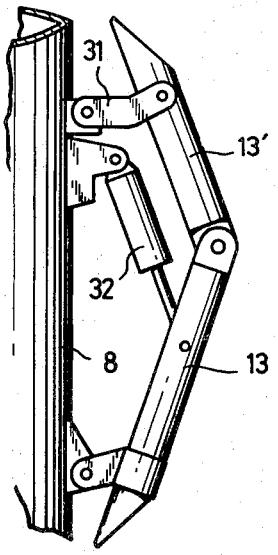

A tenth embodiment will be described with reference to FIG. 16. In this embodiment, two control plates 13, 13' are connected together pivotably in such a manner that a combination of the control plates 13, 13' can be bent at the pivot. The outer end of the control plate 13 is connected pivotably to a support cylinder 8, and the outer end of the other control plate 13' is also connected pivotably to the support cylinder 8 directly or via a link 31.

Therefore, an angle between the control plates 13, 13' in a mountain-shaped configuration can be varied by controlling the forward and backward movements of the piston in the cylinder 32. Thus, the direction, in which the machine 1 is inserted into and withdrawn from the soft ground, can be corrected.

Figure 17:
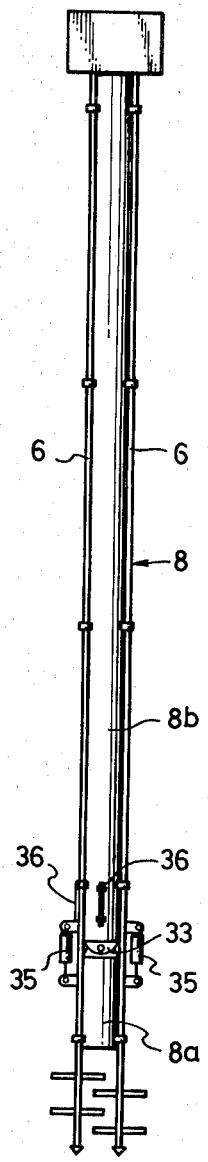
Figure 18:
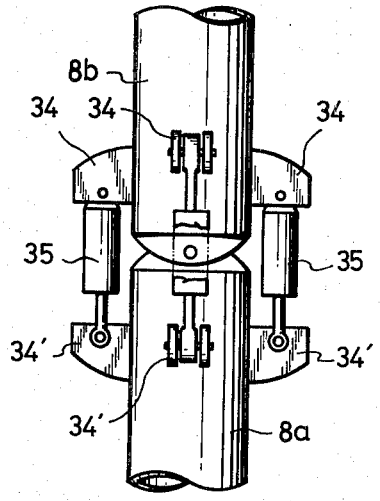
Figure 19:
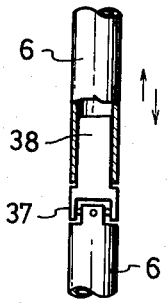

An eleventh embodiment will be described with reference to FIGS. 17–19. This embodiment is so designed that a lower member of a support cylinder can be inclined in all directions by a direction control unit. A lower member **8*a* of the support cylinder 8 is separated from an upper member 8*b* thereof. The lower member 8*a* is connected at an upper end thereof to the upper member 8*b* via a universal joint 33, so that the lower member 8*a* of the support cylinder 8 can be inclined in all directions. The universal joint 33 in use is formed by using two pins in a cross-shaped arrangement. Brackets 34, 34' are provided on those portions of the upper and lower members 8*b*, 8*a*, respectively, of the support cylinder 8 which are in the vicinity of the universal joint 33, in such a manner that the brackets 34, 34' are aligned in the vertical direction. The brackets 34, 34' are provided on four portions, which are spaced at 90° in the horizontal direction, of the outer surface of each of the upper and lower members 8*b*, 8*a* of the support cylinder 8, i.e. on eight portions in total of the upper and lower members 8*b*, 8*a*, so as to enable the lower member 8*a* to be inclined in both the longitudinal and lateral directions. A cylinder 35 is connected with pins between each pair of brackets 34, 34', which are vertically aligned with each other. In order to improve the accuracy of the direction-controlling of the lower member 8*a*, the number of the cylinders 35 may be increased. The forward and backward movements of the pistons in the cylinders 35 are controlled by a hydraulic control unit (not shown) provided on the ship 2, to regulate the direction of inclination of the lower member 8*a*. Inclination measuring instruments 36 are provided on those two portions of the outer surface of a lower section of the upper member 8*b* which are spaced at 90° in the horizontal direction, in such a manner that the measuring instruments 36 are vertically aligned with the above-mentioned cylinders 35. The measuring instruments 36 are adapted to transmit electrically a signal representative an angle of inclination of the lower member 8*a* to the ship 2**.

A lower member of an agitation shaft 6 is also separated from an upper member thereof in a position corresponding to the universal joint 33, and the lower and upper members of the agitation shaft 6 are connected together with a universal joint 37. The universal joint 37 in use has two pins in a cross-shaped arrangement. The upper member of the agitation shaft 6 is further separated into two at that portion thereof which is a little higher than the universal joint 37, and the upper and lower sections of the upper member are connected together with a slidable spline 38 or an angular rod. This allows the agitation shaft 6 to be inclined in accordance with the inclination of the support cylinder 8. When the machine 1 inserted into the soft ground is deviated from or inclined with respect to a predetermined direction, the direction control unit is operated in accordance with signals from the inclination measuring instruments 36. In such a case, the piston in the cylinder 35 provided on that side of the support cylinder 8 to which the machine 1 is deviated is moved backwardly so as to correct the direction of the lower member 8*a* of the support cylinder 8. Simultaneously with the correction of the direction of the lower member 8*a*, the machine 1 is further inserted into the soft ground perpendicularly or in a predetermined direction as the inclination of the agitation shafts 6 is eliminated. Thus, a hardened wall can be formed at a high accuracy.

The second to eleventh embodiments permit just as the first embodiment hardening the soft ground at a high accuracy. The direction control unit is provided generally on four portions of the outer circumferential surface of the machine 1. The position and number of the direction control units may be selected arbitrarily.

The present invention is not, of course, limited to the above-described embodiments; it may be modified in many other ways within the scope of the appended claims.

What is claimed is:

1. A machine for hardening the soft ground in depth, having elongated agitation shafts provided with agitation vanes at lower portions thereof and fastened rotatably to an elongated support cylinder, a rotary driving means to which the upper ends of said agitation shafts are connected, and a hardener supply unit adapted to discharge a hardener in the vicinity of said agitation vanes, comprising inclination measuring instruments provided on said support cylinder, and a direction control unit, which is provided on such a portion of said support cylinder that is close to said agitation vanes, and which has control plates operated by cylinders, whereby the direction, in which said machine is inserted into and withdrawn from the soft ground, can be controlled.

2. A machine according to claim 1, wherein said control plates in said direction control unit are capable of being inclined.

3. A machine according to claim 1, wherein said direction control unit has upper and lower control plates connected pivotably at one end portion of each thereof to said support cylinder, the remaining end portions of said control plates being connected pivotably to each other, a cylinder being provided between one of said two control plates and said support cylinder to thereby permit an angle between said control plates in a mountain-shaped configuration to be varied suitably.

4. A machine according to claim 1, wherein said direction control unit has a control plate capable of being projected sideways.

5. A machine according to claim 1, wherein said support cylinder is separated into upper and lower members, said lower member being connected to said upper member via a universal joint in such a manner that said lower member can be inclined in all directions, a plurality of jacks being provided between said lower and upper members of said support cylinder to thereby control the inclination of said lower member, said agitation shafts being so designed that a lower portion of each thereof can be inclined via a universal joint.

6. A method of hardening the soft ground in depths, wherein a machine for hardening the soft ground in depths is used to mix a hardener, which is discharged from said machine, with the soft ground by means of agitation vanes provided on said machine, and thereby harden the soft ground, comprising the steps of detecting during the insertion and withdrawal of said machine into and from the soft ground a deviation of the direction, in which said machine is inserted into or withdrawn from the soft ground, from a predetermined direction, in which said machine should be inserted into or withdrawn from the soft ground, and controlling the direction, in which a lower portion of said machine is inserted into or withdrawn from the soft ground, on the basis of a detected signal by means of a direction control unit provided above said agitation vanes, whereby said machine can be inserted into and withdrawn from the soft ground in the perpendicular or a predetermined direction.

7. A method according to claim 6, wherein said method includes the step of varying an angle of a control plate provided in said direction control unit, to press said control plate against the inner circumferential surface of a bore made by said machine.

8. A method according to claim 6, wherein said method includes the step of varying a distance at which a control plate provided in said direction control unit is projected toward the inner circumferential surface of a bore made by said machine.

9. A method according to claim 6, wherein said method includes the step of varying an angle of inclination of a lower portion of said machine by means of said direction control unit.

* * * * *